US011073167B2

(12) United States Patent
Oda

(10) Patent No.: US 11,073,167 B2
(45) Date of Patent: Jul. 27, 2021

(54) COMPRESSOR

(71) Applicant: MITSUBISHI HEAVY INDUSTRIES COMPRESSOR CORPORATION, Tokyo (JP)

(72) Inventor: Takashi Oda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 41 days.

(21) Appl. No.: 16/662,761

(22) Filed: Oct. 24, 2019

(65) Prior Publication Data

US 2020/0132088 A1 Apr. 30, 2020

(30) Foreign Application Priority Data

Oct. 25, 2018 (JP) ..... JP2018-200932

(51) Int. Cl.

| | |
|---|---|
| ***F04D 29/70*** | (2006.01) |
| ***F04D 17/00*** | (2006.01) |
| ***F01D 25/00*** | (2006.01) |
| ***F04D 29/42*** | (2006.01) |

(52) U.S. Cl.

CPC ..... *F04D 29/705* (2013.01); *F01D 25/002* (2013.01); *F04D 17/00* (2013.01); *F04D 29/4213* (2013.01); *F05D 2260/607* (2013.01)

(58) Field of Classification Search

CPC ..... F04D 29/705

See application file for complete search history.

(56) References Cited

U.S. PATENT DOCUMENTS

| | | | | |
|---|---|---|---|---|
| 4,295,895 | A * | 10/1981 | Kongshaug | F04D 29/701 134/22.18 |
| 5,193,976 | A * | 3/1993 | Kolev | F04D 29/705 415/116 |
| 8,262,365 | B2 | 9/2012 | Mathijssen et al. | |
| 2016/0115867 | A1* | 4/2016 | Zhang | F01K 23/16 60/39.182 |
| 2017/0226881 | A1 | 8/2017 | Nakaniwa et al. | |
| 2017/0254344 | A1 | 9/2017 | Nakaniwa et al. | |

FOREIGN PATENT DOCUMENTS

| | | | |
|---|---|---|---|
| CN | 202176553 | U | 3/2012 |
| EP | 3196481 | A1 | 7/2017 |
| JP | S63-243497 | A | 10/1988 |
| JP | H08-338397 | A | 12/1996 |
| WO | 2016-042825 | A1 | 3/2016 |
| WO | 2016-042826 | A1 | 3/2016 |

* cited by examiner

*Primary Examiner* — Michael Lebentritt
*Assistant Examiner* — Jason G Davis
(74) *Attorney, Agent, or Firm* — Osha Bergman Watanabe & Burton LLP

(57) ABSTRACT

A compressor 100 includes: a rotor 10 having a rotary shaft 11 rotating around an axis A, and an impeller 12 provided integrally with the rotary shaft 11; a casing 5 having a casing main body 51 which surrounds the rotor 10 and forms an annular inlet flow path F1 surrounding the axis A at a front stage of the impeller 12, and an inlet nozzle 52 which introduces a fluid into the inlet flow path F1 from an outer side in a radial direction Dr; an external pipe 2 connected to the inlet nozzle 52 to introduce the fluid from the outside to the inlet nozzle 52; and a cleaning liquid supply part 4 which is configured to supply a cleaning liquid from a plurality of locations in a circumferential direction of the external pipe 2 to an interior of the external pipe 2.

6 Claims, 4 Drawing Sheets

COMPRESSOR

BACKGROUND OF THE INVENTION

Field of the Invention

The present invention relates to a compressor.

Priority is claimed on Japanese Patent Application No. 2018-200932, filed on Oct. 25, 2018, the content of which is incorporated herein by reference.

Description of Related Art

A compressor is known as an apparatus for compressing a gas to generate a high-pressure gas. The compressor includes a rotor which rotates around an axis, an impeller provided on an outer peripheral surface of the rotor, and a casing which forms a flow path by covering the rotor and the impeller from the outer periphery side. The impeller rotates integrally with the rotor, whereby the gas flowing through the flow path is compressed. The compressed gas is in a state where the temperature and the pressure have been increased compared to before the compression.

Here, for example, in a case of causing a gas containing an organic substance such as ethylene to flow in the compressor, a compound contained in the gas is polymerized in the interior of the compressor with the rise in the temperature of the gas, so that there is a case where a polymer called fouling is formed. If such fouling adheres to a wall surface forming the flow path, there is a possibility that the efficiency of the compressor may be lowered. Further, if the fouling adheres to the rotor, there is a possibility that vibration due to imbalance of the rotor may be caused.

Therefore, as a technique for removing the fouling in the compressor, for example, the technique described in International Publication No. 2016/042825 is known. International Publication No. 2016/042825 discloses an apparatus for cleaning a region further on the downstream side than a guide vane by supplying a cleaning liquid from an inlet guide vane provided on an inlet flow path of a compressor.

SUMMARY OF THE INVENTION

However, in the configuration described in International Publication No. 2016/042825, since a nozzle for supplying the cleaning liquid is provided in the inlet guide vane, a region further on the upstream side than the inlet guide vane cannot be cleaned. Further, workability when accessing the nozzle for maintenance or the like is also limited.

The present invention provides a compressor which can be cleaned more easily and efficiently.

According to a first aspect of the present invention, there is provided a compressor including: a rotor having a rotary shaft which is configured to rotate around an axis, and an impeller provided integrally with the rotary shaft; a casing having a casing main body which surrounds the rotor and forms an annular inlet flow path surrounding the axis at a front stage of the impeller, and an inlet nozzle which is configured to introduce a fluid into the inlet flow path from an outer side in a radial direction; an external pipe connected to the inlet nozzle to introduce the fluid from an outside of the compressor to the inlet nozzle; and a cleaning liquid supply part which is configured to supply a cleaning liquid from a plurality of locations in a circumferential direction of the external pipe to an interior of the external pipe.

According to the above configuration, the cleaning liquid is supplied to the interior of the external pipe located further on the upstream side than the inlet nozzle. Therefore, the cleaning liquid can also be distributed to the inlet nozzle and the inlet flow path. Further, since the cleaning liquid supply part supplies the cleaning liquid from a plurality of locations in the circumferential direction in the external pipe, it is possible to uniformly clean the entire area in the circumferential direction in the inlet nozzle and the inlet flow path. In addition, according to the above configuration, a compressor which can be efficiently cleaned can be easily obtained only by mounting the external pipe and the cleaning liquid supply part. That is, the external pipe and the cleaning liquid supply part can be easily added to the existing compressor without renovating the interior of the compressor.

In a compressor according to a second aspect of the present invention, the cleaning liquid supply part may include a plurality of nozzle parts which are disposed at intervals in the circumferential direction of the external pipe in a state of penetrating an interior and an exterior of the external pipe and inject the cleaning liquid toward the interior of the external pipe, a circumferential flow path part which connects the plurality of nozzle parts to each other at the exterior of the external pipe, a tank part for storing the cleaning liquid, a supply flow path part which connects the tank part and the circumferential flow path part, and a pump part for pumping the cleaning liquid in the tank part to the circumferential flow path part.

According to the above configuration, the circumferential flow path part for supplying the cleaning liquid to each nozzle part is provided further on the outside of the external pipe. Therefore, it is possible to easily access the circumferential flow path part when performing maintenance.

In a compressor according to a third aspect of the present invention, the plurality of nozzle parts may be disposed at equal intervals in the circumferential direction of the external pipe.

According to the above configuration, since the plurality of nozzle parts are disposed at equal intervals in the circumferential direction of the external pipe, the cleaning liquid can be supplied uniformly over the entire area in the circumferential direction.

In a compressor according to a fourth aspect of the present invention, the external pipe may include a straight pipe part which is directly connected to the inlet nozzle and extends to form a flow path which is linear with respect to the inlet nozzle, and a curved part which is connected to the straight pipe part on a side opposite to the inlet nozzle and forms a curved flow path, and the cleaning liquid supply part may be provided in the straight pipe part.

According to the above configuration, since the cleaning liquid supply part is provided in the straight pipe part of the external pipe, the cleaning liquid can be more uniformly diffused in the external pipe. On the other hand, in a case where the cleaning liquid supply part is provided in the curved part further on the upstream side than the straight pipe part, there is a possibility that the distribution of the cleaning liquid may be biased when passing through the curved part. According to the above configuration, such a possibility can be reduced.

According to the present invention, it is possible to provide a compressor which can be cleaned more easily and efficiently.

DETAILED DESCRIPTION OF THE INVENTION

Figure 1:
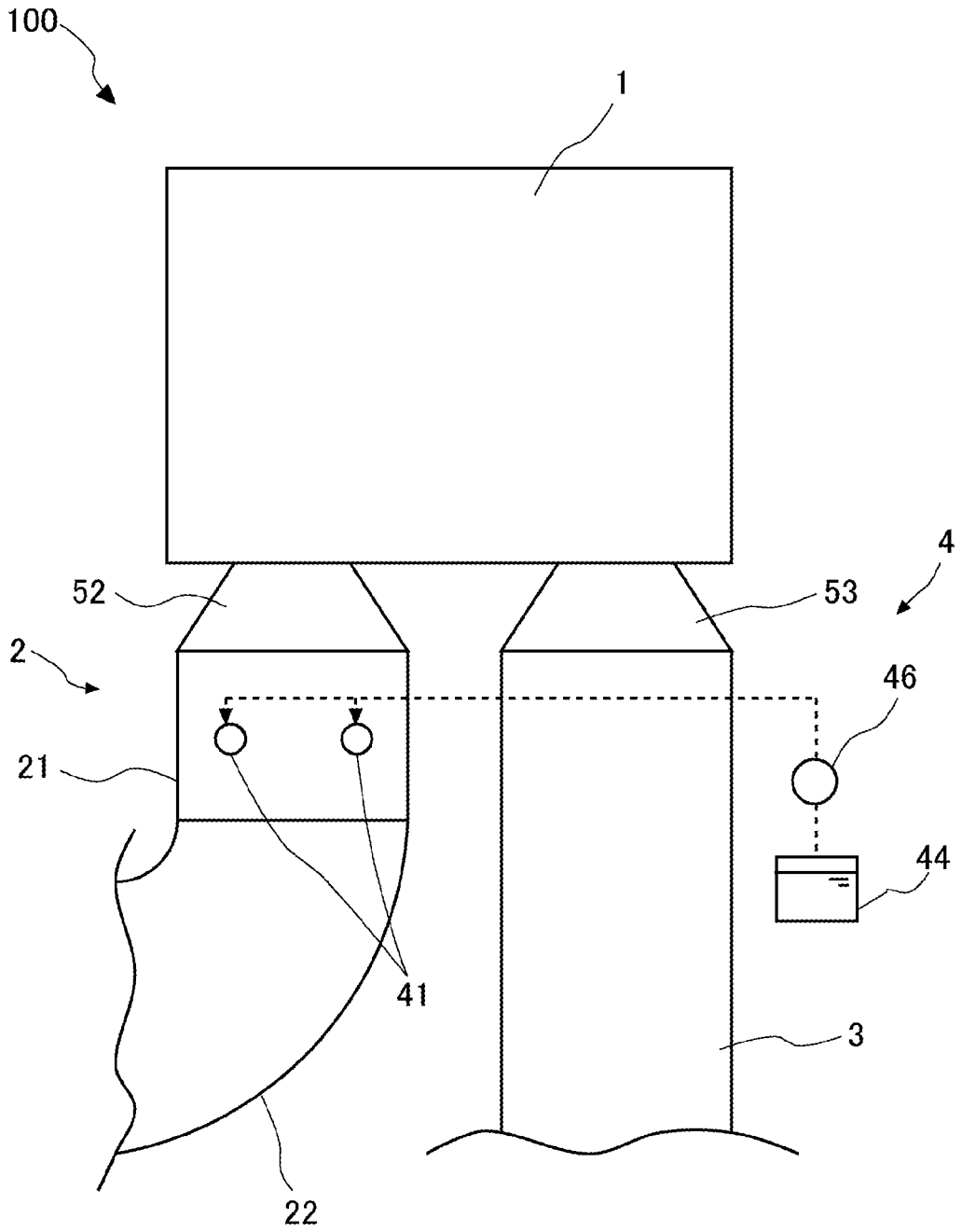
FIG. 1 is a schematic diagram showing a configuration of a compressor according to an embodiment of the present invention.

An embodiment of the present invention will be described with reference to the drawings. A compressor 100 is used in, for example, an ethylene plant. As shown in FIG. 1, the compressor 100 according to this embodiment includes a compressor main body 1 which compresses a fluid, a supply pipe (an external pipe) 2 for supplying the fluid to the compressor main body 1, a discharge pipe 3 for discharging the fluid compressed in the compressor main body 1, and a cleaning liquid supply part 4 provided in the supply pipe 2.

The compressor main body 1 uses, for example, an organic chemical substance containing ethylene gas as a fluid (a process gas). For this reason, there is a case where a polymer called fouling adheres to a wall surface which forms a flow path through which the fluid flows in the compressor main body 1 according to a continuous operation. The cleaning liquid supply part 4 is provided in order to remove this fouling with a cleaning liquid.

Figure 2:
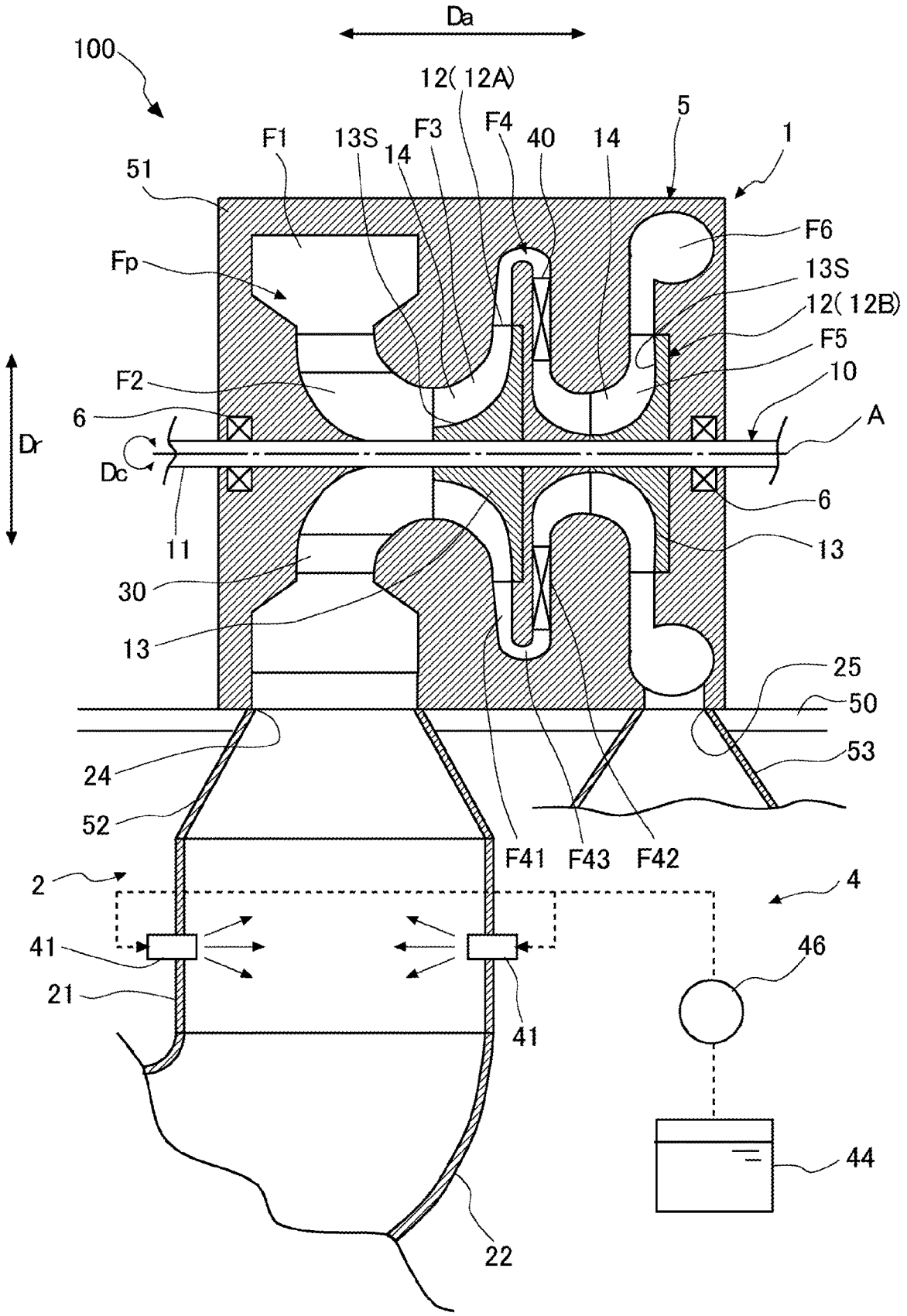
FIG. 2 is a sectional view showing the configuration of the compressor according to the embodiment of the present invention.

Hereinafter, the configuration of the compressor main body 1 will be described with reference to FIG. 2. The compressor main body 1 includes a rotor 10 which extends along an axis A, and a tubular casing 5 which covers the outer periphery side of the rotor 10. The rotor 10 extends along the axis A. The rotor 10 has a columnar rotary shaft 11 which can rotate around the axis A, and a plurality of (in this embodiment, two) impellers 12 which are provided integrally with the rotary shaft 11. In this embodiment, the axis A of the rotary shaft 11 extends in a horizontal direction. Both end portions of the rotary shaft 11 in an axial direction Da in which the axis A extends are respectively supported by bearing parts 6 so as to be rotatable with respect to the casing 5. Further, the rotary shaft 11 is connected to another rotating machine such as a transmission or a turbine (not shown).

The two impellers 12 are disposed so as to be aligned with each other in the axial direction Da at an interval with respect to the rotary shaft 11. The impeller 12 has a disk-shaped disk 13 extending from the outer peripheral surface of the rotary shaft 11 in a radial direction Dr with respect to the axis A, and a plurality of blades 14 provided on the surface on one side (a flow path forming surface 13S) of both surfaces of the disk 13 in the axial direction Da. Here, the radial direction Dr in the compressor main body 1 is a radial direction with the axis A as a reference. The flow path forming surface 13S of the disk 13 is curved so as to extend from the inner side to the outer side in the radial direction Dr as it goes from one side toward the other side in the axial direction Da. The plurality of blades 14 extending radially with the axis A as the center are provided on the flow path forming surface 13S. Although not shown in detail, each of the blades 14 is curved from one side toward the other side in a circumferential direction Dc in the compressor main body 1 as it goes from the inner side toward the outer side in the radial direction Dr. Here, the circumferential direction Dc in the compressor main body 1 is a direction along the outer peripheral surface of the rotary shaft 11 with the axis A as the center.

In this embodiment, the example in which the two impellers 12 are provided at the rotor 10 has been described. However, the number of the impellers 12 is not limited to two and may be one or three or more. Further, the impeller 12 is not limited to an open impeller which does not have a cover, as in this embodiment, and may be a closed impeller which has a cover. Further, although the two impellers 12 have the configurations equal to each other, in the following description, the impeller 12 located on one side (at a front stage) in the axial direction Da, out of the two impellers 12, is referred to as a first impeller 12A. The impeller 12 located on the other side (at a rear stage) in the axial direction Da is referred to as a second impeller 12B. Further, in the axial direction Da, the side on which the first impeller 12A is located, when viewed from the second impeller 12B, is referred to as an upstream side. In the axial direction Da, the side on which the second impeller 12B is located, when viewed from the first impeller 12A, is referred to as a downstream side.

The casing 5 has a casing main body 51 which surrounds the above-described rotor 10 from the outer side and forms a flow path Fp in the interior thereof, an inlet nozzle 52 connected to the inlet side of the flow path Fp, and an outlet nozzle 53 connected to the outlet side. The casing main body 51 has a cylindrical shape with the axis A as the center. The flow path Fp in the interior of the casing main body 51 has an inlet flow path F1, a guide flow path F2, a first compression flow path F3, a return flow path F4, a second compression flow path F5, and an outlet flow path F6, in order from one side toward the other side in the axial direction Da.

The inlet flow path F1 has an annular shape surrounding the axis A. The inlet flow path F1 is located on the upstream side (one side in the axial direction Da) of the first impeller 12A described above. One end of the inlet flow path F1 serves as an intake port 24 which communicates with the inlet nozzle 52. The inlet nozzle 52 (described later) is mounted to the intake port 24. The guide flow path F2 is connected to the inner side of the inlet flow path F1 in the radial direction Dr.

The guide flow path F2 extends so as to change a direction from the radial direction Dr to the axial direction Da as it goes from one side to the other side in the axial direction Da. The dimension of the guide flow path F2 in the axial direction Da is set to be smaller than the dimension of the inlet flow path F1. An inlet guide vane 30 is provided on the guide flow path F2. A plurality of inlet guide vanes 30 are provided radially with the axis A as the center. The inlet guide vane 30 is provided in order to rectify the flow of the fluid passing through the guide flow path F2.

The first compression flow path F3 is formed by the inner peripheral surface of the casing main body 51, the flow path forming surface 13S of the impeller 12 (the first impeller 12A), and the blade 14. The first compression flow path F3 extends so as to change the direction of the flow path from the axial direction Da to the radial direction Dr as it goes from one side toward the other side in the axial direction Da. The return flow path F4 is connected to an end portion on the outer side in the radial direction Dr of the first compression flow path F3.

The return flow path F4 has a return flow path first half F41 extending from the inner side toward the outer side in the radial direction Dr, a return flow path second half F42 which changes a direction by 180° from the return flow path first half F41 and extends from the outer side toward the inner side in the radial direction Dr again, and a turning part F43 which connects an end portion on the outer side in the radial direction Dr of the return flow path first half F41 and an end portion on the outer side in the radial direction Dr of the return flow path second half F42. A plurality of return vanes 40 disposed radially with the axis A as the center are provided in the return flow path second half F42. The return vane 40 is provided in order to rectify the flow of the fluid flowing through the return flow path second half F42. The second compression flow path F5 is connected to an end portion on the downstream side of the return flow path F4.

The second compression flow path F5 is formed by the inner peripheral surface of the casing main body 51 and the flow path forming surface 13S of the second impeller 12B, similarly to the first compression flow path F3. The second compression flow path F5 extends so as to change the direction of the flow path from the axial direction Da to the radial direction Dr as it goes from one side toward the other side in the axial direction Da. The outlet flow path F6 is connected to an end portion on the outer side in the radial direction Dr of the second compression flow path F5.

The outlet flow path F6 has an annular shape with the axis A as the center. One end of the outlet flow path F6 serves as a discharge port 25 which communicates with the outside of the casing main body 51. The outlet nozzle 53 (described later) is mounted to the discharge port 25.

The inlet nozzle 52 is provided in order to introduce the fluid from the outer side in the radial direction Dr to the inlet flow path F1 through the intake port 24. The inlet nozzle 52 is formed integrally with the casing main body 51. The inlet nozzle 52 is formed such that the cross-sectional area in a case of being viewed from the radial direction Dr gradually decreases as it goes from the outer side toward the inner side in the radial direction Dr.

The outlet nozzle 53 is provided in order to discharge the fluid from the outlet flow path F6 to the outer side in the radial direction Dr through the discharge port 25. The outlet nozzle 53 is formed integrally with the casing main body 51. Similar to the inlet nozzle 52, the outlet nozzle 53 is formed such that the cross-sectional area in a case of being viewed from the radial direction Dr gradually decreases as it goes from the outer side toward the inner side in the radial direction Dr.

Further, in this embodiment, both the inlet nozzle 52 and the outlet nozzle 53 extend in the same direction. More specifically, the inlet nozzle 52 and the outlet nozzle 53 extend from the casing main body 51 toward the lower side in the vertical direction orthogonal to the axis A (that is, the outer side in the radial direction Dr).

For example, in a case where a base plate 50 having a frame structure forms a mezzanine floor in a building, the casing main body 51 is disposed at an upper floor portion, and the inlet nozzle 52, the outlet nozzle 53, and pipes which are connected to these nozzles are disposed at a lower floor portion. That is, in an example in which the base plate 50 is assembled in a frame shape, the casing main body 51 is installed on an upper portion of the base plate 50, which is separated from the ground in the vertical direction.

The supply pipe 2 is connected to an end portion on the lower side (the outer side in the radial direction Dr) of the inlet nozzle 52. That is, the supply pipe 2 is connected to the end portion on the side opposite to the side connected to the casing main body 51 in the inlet nozzle 52. The supply pipe 2 has a straight pipe part 21 which is directly connected to the inlet nozzle 52, and a curved part 22 which is connected to the side opposite to the inlet nozzle 52 in the straight pipe part 21.

The straight pipe part 21 extends in the radial direction Dr so as to form a flow path which is linear with respect to the inlet nozzle 52. The straight pipe part 21 is a cylindrical pipe having the same diameter dimension over the entire area in the extending direction thereof.

The curved part 22 forms a flow path curved so as to extend from the straight pipe part 21 to the lower side in the vertical direction and then extend toward the upstream side in the axial direction Da. The curved part 22 has one end connected to the straight pipe part 21 and the other end connected to a fluid supply source (not shown). A bending direction or a dimension of the curved part 22 is appropriately set according to the design or specifications of the plant.

The discharge pipe 3 (refer to FIG. 1) is connected to an end portion on the lower side (the outer side in the radial direction Dr) of the outlet nozzle 53. That is, the discharge pipe 3 is directly connected to an end portion on the side opposite to the side connected to the casing main body 51 in the outlet nozzle 53. The discharge pipe 3 is provided in order to lead the compressed fluid discharged through the outlet nozzle 53 to the following various devices (not shown).

Figure 3:
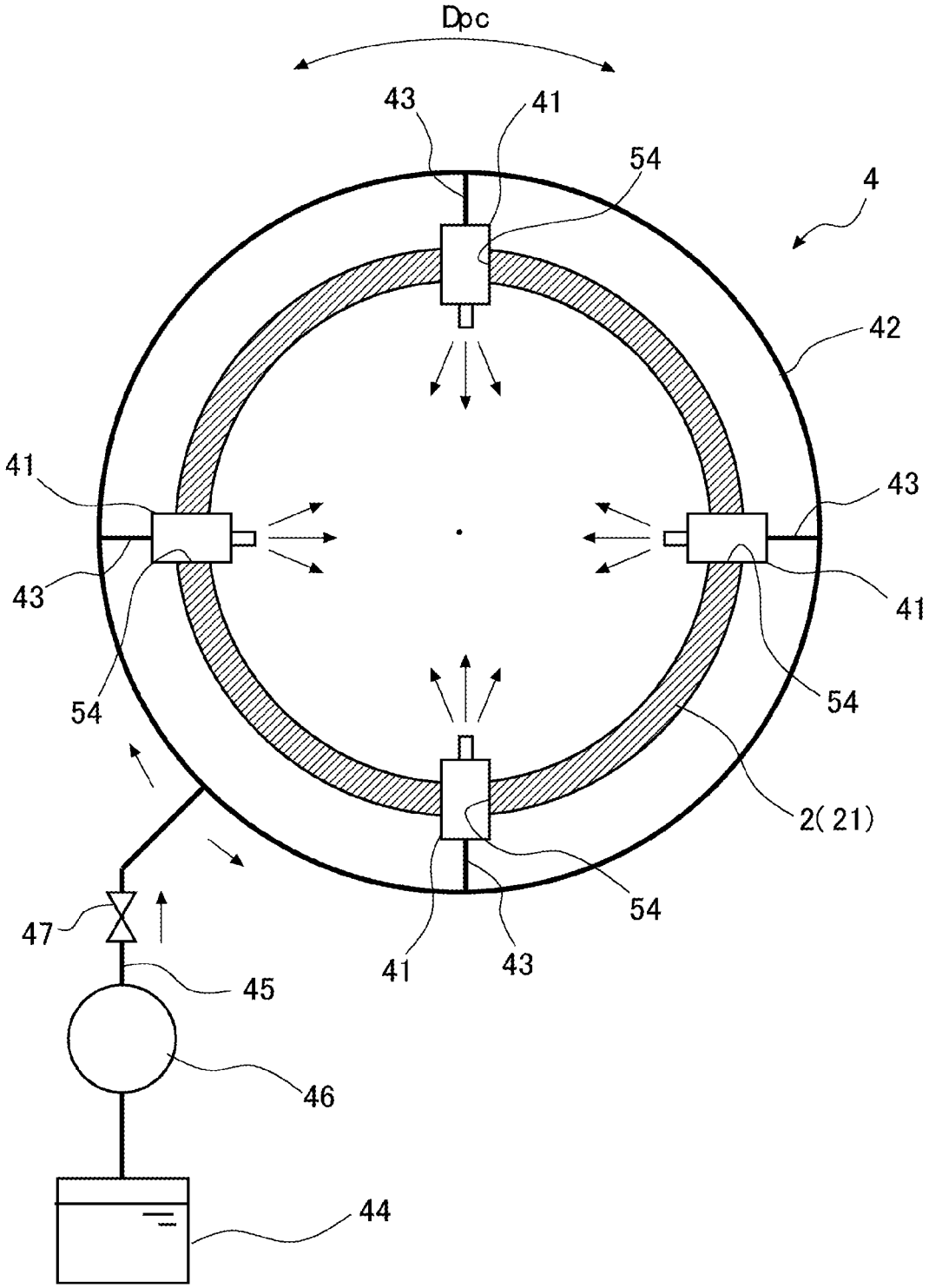
FIG. 3 is a sectional view showing a configuration of a cleaning liquid supply part according to the embodiment of the present invention.

The cleaning liquid supply part 4 is provided in the straight pipe part 21 of the supply pipe 2. As shown in FIG. 2 or 3, the cleaning liquid supply part 4 has a plurality of nozzle parts 41, a circumferential flow path part 42, a plurality of tubes 43, a tank part 44, a supply flow path part 45, a pump part 46, and a flow rate adjustment valve 47. The plurality of nozzle parts 41 are disposed at intervals in a circumferential direction (pipe circumferential direction) Dpc of the supply pipe 2. Here, the circumferential direction Dpc of the supply pipe 2 is a direction along the outer peripheral surface of the straight pipe part 21 with the central axis of the straight pipe part 21 as a reference. In this embodiment, four nozzle parts 41 are provided at equal intervals (90° intervals) in the circumferential direction Dpc of the supply pipe 2. Each nozzle part 41 is fixed to the straight pipe part 21 in a state of penetrating the interior and the exterior of the straight pipe part 21. In this way, each nozzle part 41 injects the cleaning liquid so as to diffuse the cleaning liquid toward the interior of the supply pipe 2. As the cleaning liquid, a liquid agent containing oil and fat (an organic compound) capable of decomposing and removing the fouling described above and water is used.

One circumferential flow path part 42 is connected to the four nozzle parts 41 through the tubes 43. As shown in FIG. 3, the circumferential flow path part 42 is an annular flow path provided outside the supply pipe 2. The circumferential flow path part 42 distributes the cleaning liquid supplied from the tank part 44 that stores the cleaning liquid to each nozzle part 41. The circumferential flow path part 42 is connected to the tank part 44 through the supply flow path part 45. The pump part 46 for pumping the cleaning liquid to the circumferential flow path part 42 is provided on the supply flow path part 45. The flow rate adjustment valve 47 is provided at a position closer to the circumferential flow path part 42 than the pump part 46 on the supply flow path part 45. The supply amount of the cleaning liquid which is supplied to the circumferential flow path part 42 through the supply flow path part 45 can be adjusted by the flow rate adjustment valve 47.

Figure 4:
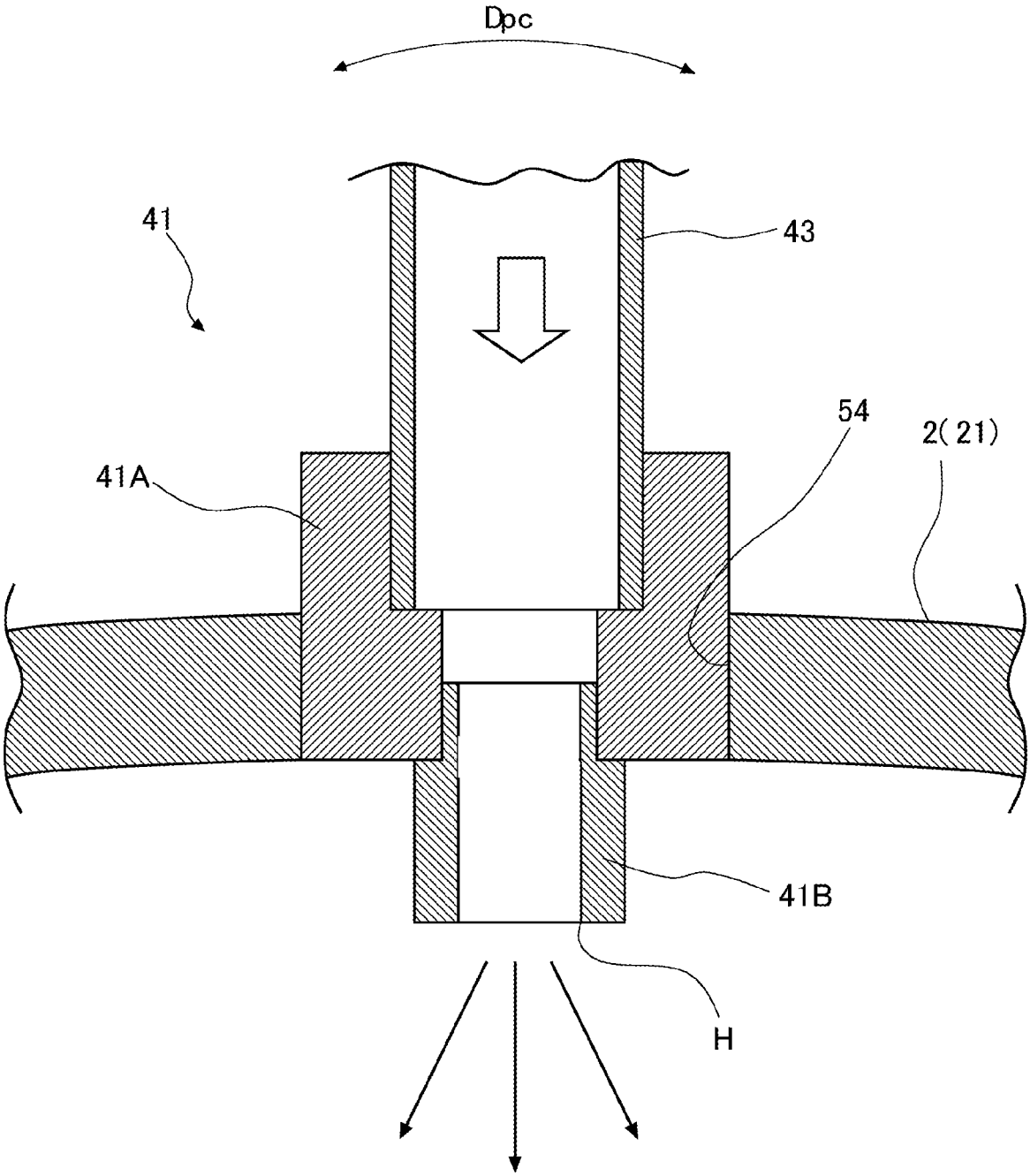
FIG. 4 is a sectional view showing a configuration of a nozzle according to the embodiment of the present invention.

As shown in FIG. 4, each nozzle part 41 has a holder part 41A which is inserted into a support hole 54 formed in the straight pipe part 21, and a nozzle main body 41B mounted to an end portion of the holder part 41A, which faces the interior of the supply pipe 2. The holder part 41A has a cylindrical shape extending perpendicularly to the outer peripheral surface of the supply pipe 2. The holder part 41A is connected to the tube 43 outside the straight pipe part 21. The nozzle main body 41B disposed so as to protrude to the interior of the straight pipe part 21 is mounted to the holder part 41A. An injection hole H communicating with the tube 43 is formed in the nozzle main body 41B. The nozzle main body 41B is a spray nozzle capable of spraying the liquid agent through the injection hole H. The cleaning liquid supplied through the tube 43 is injected from the nozzle main body 41B toward the interior of the supply pipe 2.

The four nozzle parts 41 are provided at the positions equal to each other in the direction in which the straight pipe part 21 extends (that is, the radial direction Dr with respect to the axis A). It is desirable that when the diameter dimension of the straight pipe part 21 is set to be D, the positions of the nozzle parts 41 in the radial direction Dr are disposed within the range of 1D to 6D with the lower end portion (the end portion connected to the straight pipe part 21) of the inlet nozzle 52 as a reference. More desirably, the nozzle part 41 is disposed within the range of 2D to 5D from the inlet nozzle 52. Most desirably, the nozzle part 41 is provided at the position of 3D from the inlet nozzle 52. On the other hand, in a case where the nozzle part 41 is not separated from the inlet nozzle 52 by a distance equal to or more than the diameter dimension D of the straight pipe part 21 described above, there is a possibility that the cleaning liquid injected into the straight pipe part 21 from the nozzle part 41 may flow into the inlet nozzle 52 without being sufficiently diffused. Further, in a case where the nozzle part 41 is disposed at the position farther from the inlet nozzle 52 than six times (6D) the diameter dimension D of the straight pipe part 21 described above, the straight pipe part 21 becomes longer, and therefore, the installation space for equipment is increased. Therefore, it is desirable to dispose the nozzle part 41 in the range as described above.

Next, the operation of the compressor 100 according to this embodiment will be described. In the compressor 100, a fluid is sucked into the flow path Fp from the supply pipe 2 through the inlet nozzle 52 with the rotation of the rotor 10. The fluid sucked into the flow path Fp is rectified by the inlet guide vane 30 in the guide flow path F2 described above, and then flows into the first compression flow path F3. In the first compression flow path F3, the fluid is compressed with the rotation of the first impeller 12A. The compressed fluid flows into the second compression flow path F5 through the return flow path F4. The fluid is further compressed in the second compression flow path F5 and then sent to the discharge pipe 3 through the outlet flow path F6 and the outlet nozzle 53.

Here, for example, in a case of causing a gas containing an organic substance such as ethylene to flow through the compressor 100 as the fluid, a compound contained in the gas is polymerized in the interior of the compressor 100 due to a temperature rise when the gas is compressed. In this way, there is a case where a polymer called fouling is formed in the interior of the compressor 100. If such fouling adheres to the wall surface of the flow path Fp, there is a possibility that the efficiency of the compressor 100 may be lowered. Further, if the fouling adheres to the impeller 12, there is a possibility that vibration due to the imbalance of the rotor 10 may be caused.

Therefore, in the compressor 100 according to this embodiment, a cleaning liquid is supplied to the flow path Fp by the cleaning liquid supply part 4. Specifically, the cleaning liquid is injected radially from each nozzle part 41 to the interior of the straight pipe part 21. The cleaning liquid injected from each nozzle part 41 flows into the inlet nozzle 52 from the straight pipe part 21 along with the flow of the fluid, and flows through the flow path Fp. In this way, the inlet nozzle 52, the inlet flow path F1, the guide flow path F2, the inlet guide vane 30, the first compression flow path F3 (the first impeller 12A), the return flow path F4, the second compression flow path F5 (the second impeller 12B), and the outlet flow path F6, which are on the path through which the cleaning liquid flows, are cleaned, so that the fouling can be removed. The removed fouling residue is discharged to the outside through a drain pipe (not shown).

According to such a configuration, the cleaning liquid is supplied to the interior of the supply pipe 2 located further on the upstream side than the inlet nozzle 52. Therefore, the cleaning liquid can also be distributed to the inlet nozzle 52 and the inlet flow path F1.

Further, since the cleaning liquid supply part 4 supplies the cleaning liquid from a plurality of locations in the circumferential direction Dpc of the supply pipe 2, it is possible to uniformly clean the entire area of the flow path cross section orthogonal to the flow direction in the inlet nozzle 52 and the inlet flow path F1.

In addition, according to the configuration described above, the compressor 100 which can be efficiently cleaned can be easily obtained only by mounting the supply pipe 2 and the cleaning liquid supply part 4. That is, the supply pipe 2 and the cleaning liquid supply part 4 can be easily added to the existing compressor main body 1 from the outside of the compressor main body 1 without renovating the interior of the compressor main body 1. Therefore, it is possible to provide the compressor 100 which can be cleaned more easily and efficiently.

Further, in a case where the circumferential flow path part 42 is formed in, for example, the interior of the straight pipe part 21, since it is necessary to disassemble the straight pipe part 21 when performing maintenance, the workability is lowered. However, the circumferential flow path part 42 for supplying the cleaning liquid to each nozzle part 41 is provided at the outside of not only the compressor main body 1 but also the straight pipe part 21. Therefore, it is possible to easily access the circumferential flow path part 42 when performing maintenance.

In addition, since the plurality of nozzle parts 41 are disposed at equal intervals in the circumferential direction Dpc of the supply pipe 2, the cleaning liquid can be uniformly supplied to the straight pipe part 21 over the entire area in the circumferential direction Dpc.

In addition, the cleaning liquid supply part 4 is provided in the straight pipe part 21 directly connected to the inlet nozzle 52 in the supply pipe 2. For this reason, the cleaning liquid can be more uniformly supplied to the inlet nozzle 52. In a case where the cleaning liquid supply part 4 is provided in the curved part 22 further on the upstream side than the straight pipe part 21, there is a possibility that the distribution of the cleaning liquid may be biased when passing through the curved part 22. As a result, the cleaning liquid reaches the inlet nozzle 52 while being biased, and thus there is a possibility that cleaning may not be performed effectively. However, according to the configuration described above, such a possibility can be reduced.

Other Modification Examples of Embodiment

The embodiment of the present invention has been described in detail above with reference to the drawings. However, each configuration in each embodiment and combinations of these configurations are examples, and additions, omissions, substitutions, and other changes of configurations can be made within a scope which does not depart from the gist of the present invention. Further, the present invention is not limited by the embodiment and is limited only by the claims.

For example, in the embodiment described above, the example in which the cleaning liquid supply part 4 has the four nozzle parts 41 has been described. However, the number of the nozzle parts 41 is not limited to four and can be appropriately changed based on the diameter dimension of the supply pipe 2 or the degree of diffusion of the cleaning liquid. Further, the cleaning liquid supply part 4 may be provided over a plurality of stages at intervals in the direction in which the supply pipe 2 extends. Further, in this case, the positions of the nozzle parts 41 in the circumferential direction Dpc of the supply pipe 2 may be different between the stages adjacent to each other. According to such a configuration, the cleaning liquid can be supplied more uniformly.

Further, in the embodiment described above, the example in which the supply pipe 2 is composed of two pipes including the straight pipe part 21 and the curved part 22 has been described. However, the configuration of the supply pipe 2 is not limited to the above, and the straight pipe part 21 and the curved part 22 may be integrally formed.

Further, there is no limitation to the configuration in which the interior of the compressor main body 1 is cleaned only by the cleaning liquid supply part 4. For example, a structure for injecting a cleaning liquid into the return flow path F4 in the compressor main body 1 may be provided separately from the cleaning liquid supply part 4. In that case, it is preferable to provide a structure such as a nozzle for injecting a cleaning liquid to the turning part F43 of the return flow path F4.

EXPLANATION OF REFERENCES

1: compressor main body
2: supply pipe
3: discharge pipe
4: cleaning liquid supply part
5: casing
6: bearing part
10: rotor
11: rotary shaft
12: impeller
13: disk
14: blade
21: straight pipe part
22: curved part
24: intake port
30: inlet guide vane
40: return vane
41: nozzle part
42: circumferential flow path part
43: tube
44: tank part
45: supply flow path part
46: pump part
47: flow rate adjustment valve
50: base plate
51: casing main body
52: inlet nozzle
53: outlet nozzle
54: support hole
100: compressor
12A: first impeller
12B: second impeller
13S: flow path forming surface
41A: holder part
41B: nozzle main body
A: axis
F1: inlet flow path
F2: guide flow path
F3: first compression flow path
F4: return flow path
F41: return flow path first half
F42: return flow path second half
F43: turning part
F5: second compression flow path
F6: outlet flow path
Fp: flow path
Da: axial direction
Dr: radial direction
Dc: circumferential direction of compressor main body
Dpc: circumferential direction of supply pipe (pipe circumferential direction)

What is claimed is:

1. A compressor comprising:
a rotor comprising:
a rotary shaft which is configured to rotate around an axis; and
an impeller disposed integrally with the rotary shaft;
a casing comprising:
a casing main body which surrounds the rotor and forms an annular inlet flow path surrounding the axis at a front stage of the impeller; and
an inlet nozzle which is configured to introduce a fluid into the inlet flow path from an outer side in a radial direction;
an external pipe connected to the inlet nozzle to introduce the fluid from an outside of the compressor to the inlet nozzle; and
a cleaning liquid supply part which is configured to supply a cleaning liquid from a plurality of locations in a circumferential direction of the external pipe to an interior of the external pipe, wherein
the cleaning liquid supply part comprises a plurality of nozzle parts that are disposed at intervals in the circumferential direction of the external pipe in a state of penetrating the interior and an exterior of the external pipe and that inject the cleaning liquid toward the interior of the external pipe.

2. The compressor according to claim 1, wherein the cleaning liquid supply part further comprises:
a circumferential flow path part which connects the plurality of nozzle parts to each other at the exterior of the external pipe;
a tank part for storing the cleaning liquid;
a supply flow path part which connects the tank part and the circumferential flow path part; and
a pump part for pumping the cleaning liquid in the tank part to the circumferential flow path part.

3. The compressor according to claim 2, wherein the plurality of nozzle parts are disposed at equal intervals in the circumferential direction of the external pipe.

4. The compressor according to claim 3, wherein the external pipe comprises:
a straight pipe part which is directly connected to the inlet nozzle and extends to form a flow path which is linear with respect to the inlet nozzle; and
a curved part which is connected to the straight pipe part on a side opposite to the inlet nozzle and forms a curved flow path, and the cleaning liquid supply part is disposed in the straight pipe part.

5. The compressor according to claim 2, wherein the external pipe comprises:

a straight pipe part which is directly connected to the inlet nozzle and extends to form a flow path which is linear with respect to the inlet nozzle; and a curved part which is connected to the straight pipe part on a side opposite to the inlet nozzle and forms a curved flow path, and the cleaning liquid supply part is disposed in the straight pipe part.

6. The compressor according to claim 1, wherein the external pipe comprises:

a straight pipe part which is directly connected to the inlet nozzle and extends to form a flow path which is linear with respect to the inlet nozzle; and a curved part which is connected to the straight pipe part on a side opposite to the inlet nozzle and forms a curved flow path, and the cleaning liquid supply part is disposed in the straight pipe part.

* * * * *